United States Patent [19]

Vesterinen

[11] Patent Number: 4,631,886

[45] Date of Patent: Dec. 30, 1986

[54] METHOD AND SYSTEM FOR THE FACING OF STRUCTURES

[75] Inventor: Kauko I. Vesterinen, Helsinki, Finland

[73] Assignee: Rakennus - Ja Konsulttitoimisto Risto Hukka Ky, Kerkonjoensuu, Finland

[21] Appl. No.: 643,078

[22] Filed: Aug. 22, 1984

[30] Foreign Application Priority Data

Aug. 23, 1983 [FI] Finland ..... 833015

[51] Int. Cl.[4] ..... E04B 1/38; E04C 1/10; E04C 2/08

[52] U.S. Cl. ..... 52/410; 52/508; 52/595

[58] Field of Search ..... 52/595, 578, 309.9, 52/410, 588, 506, 508, 404

[56] References Cited

U.S. PATENT DOCUMENTS

| | | | |
|---|---|---|---|
| 3,427,775 | 2/1969 | Bachrich | 52/404 X |
| 3,590,545 | 7/1971 | Webb | 52/595 X |
| 3,906,696 | 9/1975 | Poter et al. | 52/595 X |
| 4,075,810 | 2/1978 | Zakrzewski et al. | 52/588 X |
| 4,143,498 | 3/1979 | Martin, Jr. et al. | 52/595 X |
| 4,244,269 | 1/1981 | Gorell | 52/506 X |
| 4,283,897 | 8/1981 | Thompson | 52/588 X |
| 4,316,351 | 2/1982 | Ting | 52/595 X |
| 4,337,606 | 7/1982 | Revsser | 52/595 X |
| 4,426,061 | 1/1984 | Taggart | 52/410 |
| 4,463,531 | 8/1984 | Peretto | 52/595 X |

FOREIGN PATENT DOCUMENTS

| | | |
|---|---|---|
| 3028014 | 2/1982 | Fed. Rep. of Germany . |
| 3243936 | 6/1983 | Fed. Rep. of Germany . |
| 3510 | 7/1963 | Finland . |
| 60279 | 8/1981 | Finland . |
| 62701 | 10/1982 | Finland . |
| 7305036 | 10/1976 | Switzerland . |
| 7610381 | 6/1978 | Switzerland . |
| 7812939 | 7/1981 | Switzerland . |
| 2055129 | 2/1981 | United Kingdom . |
| 1602668 | 11/1981 | United Kingdom . |

*Primary Examiner*—John M. Jillions

*Attorney, Agent, or Firm*—Browdy and Neimark

[57] ABSTRACT

A method for the facing of structures, wherein the understructure (14) is faced with several facing panels mounted one after and/or one next to the other; the panels to be fixed to the understructure (14) at a distance from the understructure (14) in such a way that space is allowed for insulation (12), (13) or the like. According to the invention one or more separate supporting beads (10) are pushed between the panel edgings (2), (3) and the panels are mounted onto the surface of the understructure (14) one by one covering an area of the panel's size, the operations being: placing of insulation (12), (13), fixing of a separate fastening device (22), (23) to one fastening edging (2) of the panel, slipping the other fastening edging (3) of the thus obtained panel and fastening device combination into the fastening edging (2) of an already mounted panel, and turning the panel and fixing it to the understructure. The subject matter of the invention also comprises a system for the realization of the method. The system is based on planar panels with interlocking grooved edgings (2), (3) to which separate supporting beads (10) and fastening devices (22), (23) are fixed.

8 Claims, 7 Drawing Figures

FIG. 1
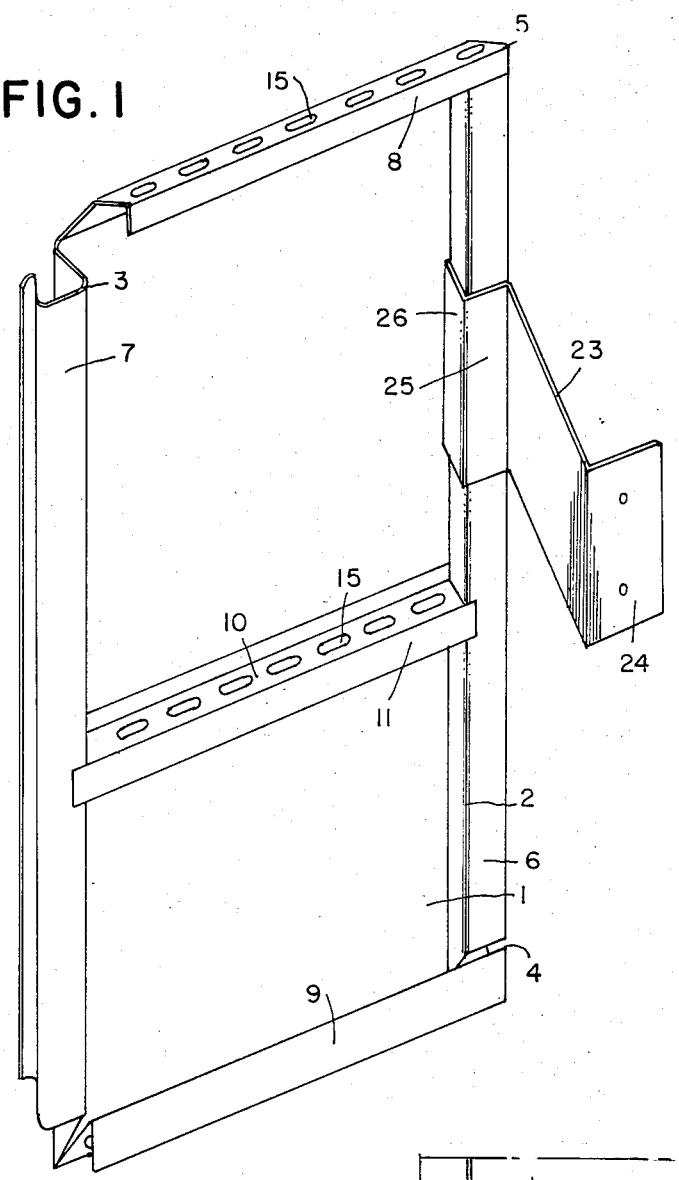
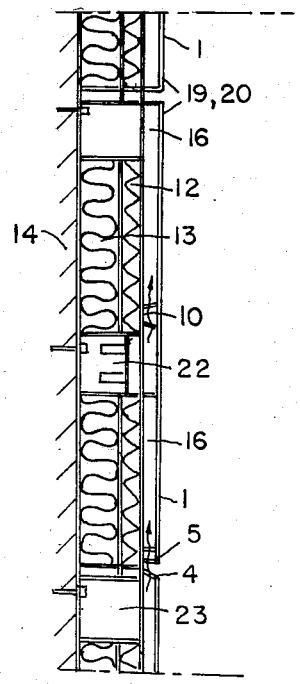
FIG. 3
FIG. 2
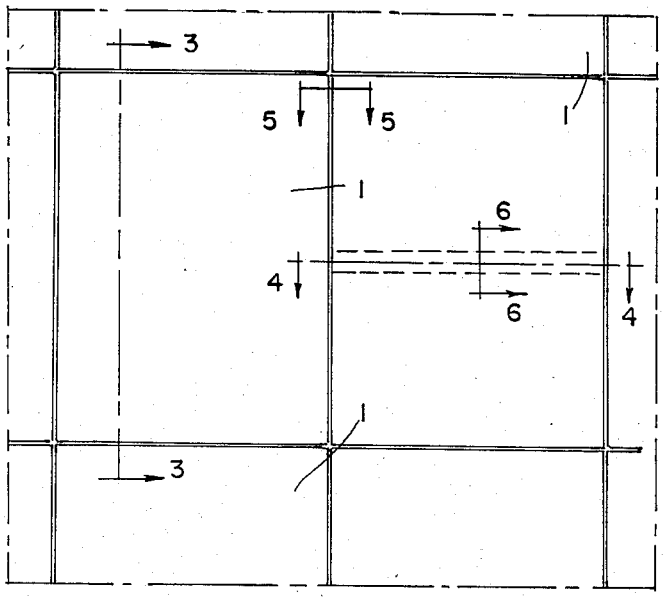

METHOD AND SYSTEM FOR THE FACING OF STRUCTURES

The subject matter of the invention is a method for the facing of structures, wherein a possibly uneven understructure is faced with several facing panels mounted one after and/or one next to the other, to possibly be coated after mounting, in which method said panels are fixed to the understructure preferably at a distance from the understructure in such a way that space is allowed for insulation or the like between the understructure and the outer face of the single panel; each of the facing panels proper having a planar dimension approximately parallel with the understructure and each panel surface, at least in the inner area of the facing, being surrounded by edgings generally directed towards the understructure, designed in such a way that the panel extends away from the understructure so as to provide, at least in part, enough space within the panel for the arrangement of air circulation within the panel covering nearly the whole surface; at least two opposite edgings of each panel being designed as longitudinally and mutually interlocking fastening edgings. The subject matter of the invention is also a system for the facing of structures for the adapation of the invented method, a system consisting of several adequately nearly equisized proper panels forming the surface or subsurface of the structure and of possible edgings, gables or other such parts, said panels and accessory parts being fixed to the understructure suitably, at such a distance as to leave space between the panels and the understructure for insulation or the like, each of said panels proper having a planar dimension approximately parallel with the understructure, and at least two opposite edgings of each panel being designed as longitudinally and mutually approximately interlocking fastening edgings reaching from the panel surface toward the understructure.

Previously known are various so called facade panels made from, in particular, sheet metal, plastic and like materials, used to reface especially old buildings in connection with renovation work. The aim is then to give the building a new exterior surface which will remain visible as such or will provide a base for possible coating such as painting or plastering. These facing systems often consist of plate assemblies suspended vertically next to and above one another over the understructure to be faced. As an example of such a system may be mentioned a facing system based on FI Pat. Nos. 60 279 and 62 701, wherein additional insulation is placed between mounting rails horizontally affixed to the wall, whereafter facing assemblies of galvanized sheet are suspended from the rails in such a manner that the downward bent back edge of an outward inclined divider strip is resting on the rail. A corresponding system is marketed under the trade name of "Structuroc" consisting of facing assemblies affixed to horizontal frames using flexible fasteners. It is a common feature of both these facing systems that they require that (a) the fixing of the supporting frames, (b) the insertion of the insulation and (c) the fastening of the facing assemblies are performed as three completely separate operations over the whole surface to be faced. This means that the work will involve much moving on scaffolding that covers the whole area to be faced and that all preparatory work must be done with particular care, as the supporting frames must be fixed in such a way that the standard-size assemblies with their regularly placed fastening and supporting devices will fit the framework. This means that the supporting frames must always be spaced according to the size of the assemblies and in consequence it is difficult to take special considerations such as wind load into account.

Previously known are also other types of facing materials, usually composed of sheet metal or plastic panels. As examples may be mentioned facing to be affixed directly onto the wall using separate fixing devices as described in SE Pat. No. 326 815 and SE open-laid publication No. 7305036-1, where adjacent facing layers overlap to such an extent as to prevent the access of water. This is also the object of designing the form of the facing panel joints to lock the panels together at the same time forming grooves that prevent the access of water, as shown in, for example, SE open-laid publication No. 7812939-2, FI patent application No. 3510/68 and SE publication No. 7610381-1. In the first mentioned system a panel is first fixed directly onto the understructure before the fixing of the next panel. In the last mentioned system the facade panels are fixed to each other as well as to fastening rails vertically mounted on the understructure. Common to all these facing systems is the sole object of constructing a new facade surface, as the system of mounting precludes the formation of a space for possible insulation between the panels and the understructure.

To eliminate the drawbacks of the prior known facade systems and to facilitate and speed up mounting, the facing system according to the present invention had been developed, wherein the panels are mounted at a suitable distance from the understructure for purposes of e.g. additional insulation, said system differing, however, from the corresponding prior known systems in that the mounting is performed without a supporting framework covering the structure. In the invented method the solution to this is that the panels—to which, preferably prior to mounting, at least one supporting bead per panel is fixed between the insides of the edgings turned toward the understructure, by pushing or in some other way, to prevent buckling of the panel surface and a possible bending of said edgings, said beads supporting an optional insulating material—are mounted one by one onto the surface of the understructure covering always a surface of approximately the same size as said panel, in such a manner that said optional layer of insulation is suitably added as a separate operation covering the understructure area also covered by said panel to be mounted, after which at least one separate fastening device is fixed to one of the panel's fastening edgings, said device being considerably shorter than said panel edging and possibly length adjustable toward the understructure, said device including a part that can be fastened to the understructure, after which the opposite fastening edging of the combined panel and fastening device is slipped into the fastening edging of the adjacent panel which is already fixed with a fastening device to the understructure or into the fastening edging of a separate gable piece, then turning the other side of said panel to be fixed toward the understructure whereto said fastening device is fixed so that said optional insulation is evenly pushed against the understructure by the sides of said panel and said supporting bead.

The facing system developed for carrying out the invented method is chararcterized in that the longitudinal form of the fastening edgings of the panels is such that the interlocking edgings of adjacent panels will lock together when the angle between the panel surfaces is changed, and also such that it is possible to attach to at least that side of the fastening edging that is away from the side interlocked with another panel at an arbitrary point along the length of the side, one or more separate fastening devices per panel of an, at least in part, approximately similar cross-sectional form as the edging, said fastening device being considerably shorter than the length of said side and possibly adjustable in the transverse direction from the panel surface, and its purpose being the fixing of each panel to the understructure, in addition to which the fastening edgings are supported by at least one supporting bead, pushed into position between the edging sides against the inner surface of said panel at a nearly arbitrary point as a separate operation, which bead serves to push the opposite fastening edgings of said panel in opposite directions, and also to prevent buckling of said panel surface by supporting the surface from inside the panel.

The invention provides, for example, a facing system for facades or other structures which combines work saving with flexible mounting. This is particuarly advantageous when various effects on any structural surface must be considered, such as, for example, wind loads or mechanical loads. As the invented method is based on the use of separate fastening devices and supporting beads that can be fixed arbitrarily, it is easy to take special requirements into account. Also the need to move several times over the whole surface to be faced is eliminated, as the invention provides for mounting of the panels including supporting and fastening devices and an optional insulation layer, working by area unit to make the facing complete. In practice this means that it is enough to work over the surface once instead of thrice. As there is no need of scaffolding to cover the whole structure, considerable saving is achieved by using smaller scaffolds movable along the structure.

The invention provides particular advantages, as the use, as needed, of arbitrarily placed supporting beads and fastening devices will support the panel surface at frequent intervals, making the surface rigid and level. This rigidity is of particular importance, for example, when the panel surface is to be plastered. A further advantage is provided when applying the invention to uneven surfaces. as each panel is always separately mounted taking into account the distance between the understructure and the panel surface, which can be adjusted using the length adjustable fastening devices of one embodiment of the invention. A corresponding mounting using a system of supporting frames or direct mounting onto the understructure would require the use of spacers, which makes mounting extremely complicated. Especially when facing old structures, the evenly spaced points of fixing the framework will often coincide with such structural joints that complicate fastening, which means that no fastening will perhaps in fact be done. The arbitrary placing of the fastening devices as described in the invention will eliminate this problem.

Next a preferred embodiment of the invented method on a facing system will be described with references to the drawings:

FIG. 1 represents a facing panel according to the invention as seen from behind.

FIG. 2 represents a part of a level wall surface onto which a system according to the invention has been mounted.

FIG. 3 represents a section of FIG. 2 at A to A.

Figure 5:
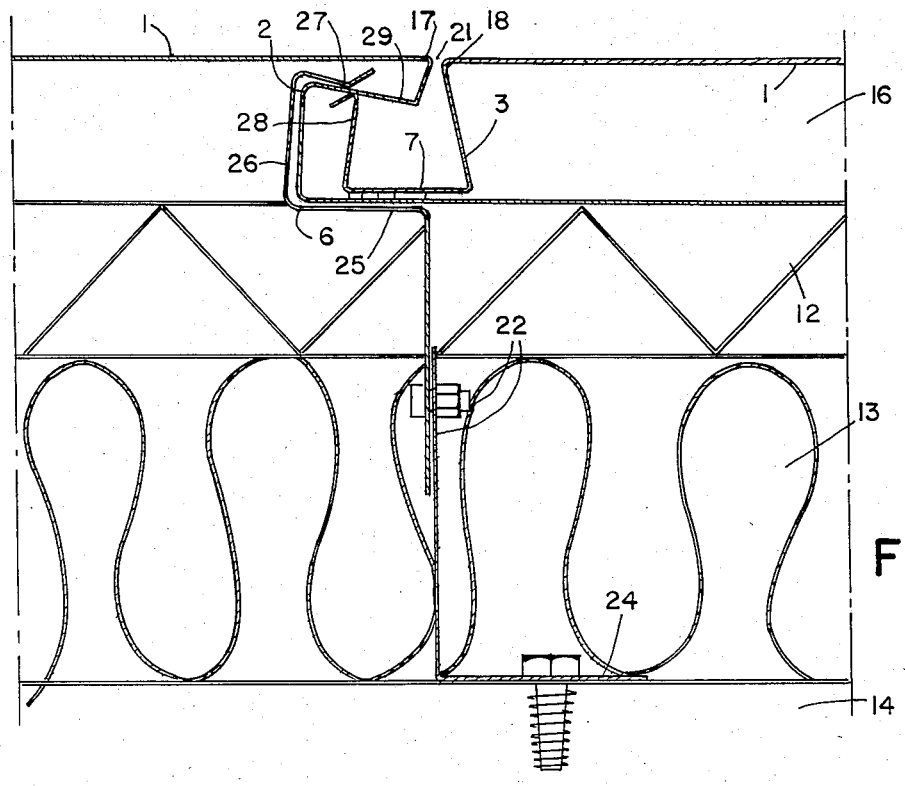
FIG. 5 represents a section of FIG. 2 at C to C.
Figure 4:
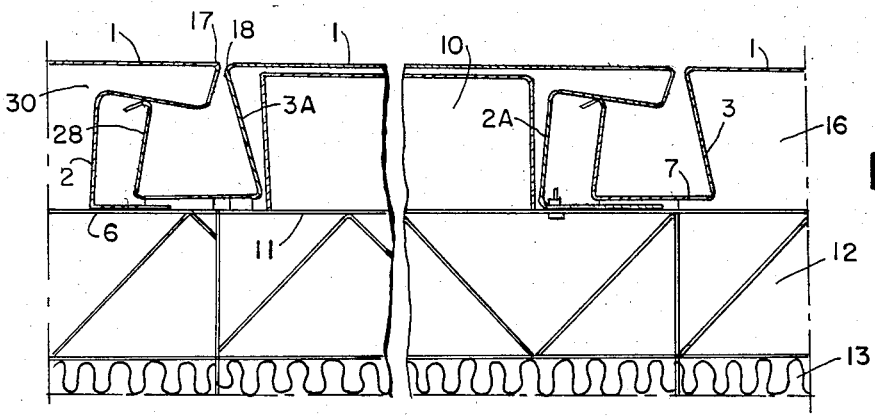
FIG. 4 represents a section of FIG. 2 at B to B.
Figure 6:
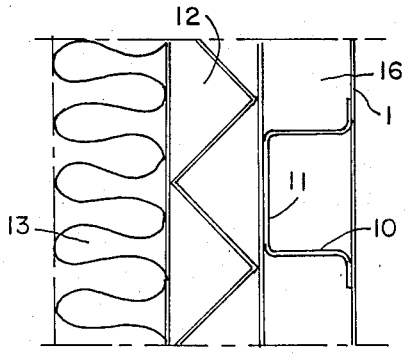
FIG. 6 represents a section of FIG. 2 at D to D.
Figure 7:
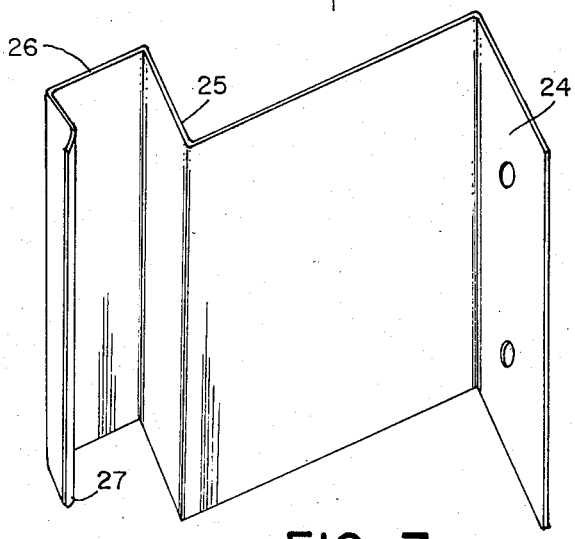
FIG. 7 represents an embodiment of a separate fastening device according to the invention.

According to the invention a facing panel is typically composed of a suitably fashioned smooth or textured surface (1) of aluminium, copper or galvanized sheet or, for example, of plastic or some corresponding flat material, suitably surrounded by opposed fastening edgings (2) and (3), and gable edgings (4) and (5). The edgings (2), (3), (4) and (5) have supporting surfaces (6), (7), (8) and (9) which suitably combined with the supporting surface (11) of a supporting bead (10) push the insulating material (12), (13) against the understructure (14). The gable edgings (4) and (5), and the supporting bead (10) are preferably perforated (15) to ensure air flow in the ventilation gap (16). In preferred mounting the insulation comprises a lighter layer of insulation wool (13) and a more rigid layer of insulation acting as wind protection (12).

The facing panels are fixed next to each other in such a way that the edges (17), (18), (19) and (20) of the surfaces (1) are approximately flush and a small distance from each other, the slit (21) to be suitably filled with cement or some corresponding filling as the mounting proceeds.

The fixing onto the understructure (14) is according to the invention done with separate, almost arbitrarily placed adjustable or standard length fastening devices (22), (23). At one end of the fastening device (22), (23) there is a part (24) for fixing the fastening device (22), (23) to the understructure (14). The facing panel end of the fastening device (22), (23) is in the preferred embodiment formed by a supporting surface (25) and going out from it, an intermediate part (26) finishing with a suitably flexible tongue projection (27). The fastening device (22), (23) is preferably attached to the fastening edging (2) providing some flexibility in such a way that the flexible tongue projection (27) of the fastening device (22), (23) from the other side (29) of the profile will suitably push against the fastening edging (2), in such a manner that its supporting surface (6) rests on the supporting surface (25) of the fastening device (22), (23), whereby the final distance between the edging (2) and the understructure (14) is determined by the length of the fastening device (22), (23).

A preferred embodiment of the invention includes opposite fastening edgings (2) and (3) of the facing panels, said edgings having their profiles so designed that one profile is primarily composed of the back surface (7) supporting the edging (3) and extending outside the edge (18) of the panel surface (1) to determine the final distance between the panel's fastening edging (3) and the understructure (14) via the supporting surface (6) of the fastening edging (2) of the adjacent panel. From the outer edge of the back surface (7) a suitably flexible tongue projection (28) extends towards the panel surface (1) up to the inner surface (29) of the groove in the fastening edging (2) of the adjacent panel. The other edging profile (2) of the panel is primarily composed of a groove bent from the edge (17) of the panel surface toward the center of the panel and opening toward the edge (17), the inner surface (29) of said groove toward the panel surface (1) acting together with the flexible tongue projection (28) of the fastening edging (3) of the adjacent panel, and the supporting side (6) of this groove away from the surface (1) acting together with the supporting surface (7) of the fastening edging (3) of the adjacent panel. The fastening edgings (2), (3) and surface (1) of each panel are supported by at least one supporting bead (10) pushed between the sides (2A), (3A) of the fastening edgings (2), (3), and said bead with suitable flexibility pushes the panel edgings (2) and (3) from each other, causing the panel surface (1) to be pressed against the supporting bead (10) achieving a flexibly level surface (1). As the number of supporting beads (10) is almost arbitrary, support intervals demanded by load can be determined according to need for each panel surface (1), so that the panel surface (1) will always be level and press flexibly against the supporting bead (10). A separate fastening device (22), (23) surrounds (25–26–27) the outer surface of the groove profile at the inside of the panel, its supporting surface (25) and its flexible tongue projection (27) providing suitable flexibility at the side (29) of the groove turned toward the panel surface (1) and at the supporting surface (6) of the groove turned away from the surface (1). The points of contact between the fastening device (22), (23) and/or the fastening edgings (2), (3) are optionally provided with surface formations such as grooves, protuberances or the like, improving the grip particularly in the direction of the edgings.

In the shown embodiment the fastening device (22), (23) is attached to the fastening edging (2) turned away from the panel already mounted on the understructure (4) by slipping the flexible tongue projection (27) of the fastening device (22), (23) turned towards the center of the panel into the slit (30) between the fastening edging (2) turned toward the panel surface (1) and the panel surface (1). By righting the fastening device (22), (23) away from the panel surface (1) the fastening device (22), (23) is locked in a suitable position for mounting. After this, the panel, having been provided with one or more fastening devices (22), (23), is fixed by inclining it toward the adjacent panel of which the fastening edging (2) has already been fixed to the understructure (14) using its own fastening device (22), (23), by slipping the flexible tongue projection (28) of its other fastening edging (3) into the fastening edging (2) of the fixed panel, and by inclining it against the fixed panel, after which it is locked into place by turning it around the axis of the fixed side (2).

Above is described an embodiment of the invention, wherein panels are mounted on a wall understructure (14) in such a way that the fastening edgings (2), (3) are vertical and the panel is supported vertically by one or more fastening devices (22), (23) and possibly by the panel below or by a special part, resting on the head (4), (5) suitably perforated (15) for ventilation and inclining upward from the panel surface toward the understructure (14). The invention can also be advantageously applied where the understructure is more or less inclined or even horizontal. Further the system according to the invention allows the use of special parts which have one or more of the characteristic features of the invention. Said parts can be combined with the proper facing panels, especially where the system is connected to other structures such as in corners, by openings, etc.

In another embodiment of the invention the gable edgings (4), (5) of the panel, which do not form such fastening edgings (2), (3) as those mentioned above, are so fashioned that adjacent panels can be fixed together using a locking device which is pushed along the meeting gable edgings (4), (5). This is conveniently achieved by providing the gable edgings (4), (5) of the connecting panels with bends of an approximately L-shaped cross-section toward the centers of the panels, which will combine to give the gables of two adjacent panels a side with T-shaped cross-section. When a locking device surrounding the projection is slipped over the projecting parts of the side, the result is that the mounted panels are suitably locked along all sides. This ensures, for example, that the panels will remain in place and facilitates any further treatment.

Above are described such embodiments of the invention as particularly aim at the possibility of adding insulation. Thanks to the arbitrary placing of the fastening and supporting devices the invention can, however, also be applied for purposes where space is required e.g. for pipes or cables behind the surface structure. Such applications are, for example, false ceilings in technical premises.

What is claimed is:

1. A system for the facing of construction, said system consisting of several practically equalized proper panels forming a surface of the structure, said panels being fixed to an understructure (14) at such a distance as to leave space between said panels and said understructure (14) for insulating means; each of said panels having a planar surface approximately parallel with said understructure (14) and at least one pair of opposing edgings (2), (3), one of the edgings of said one pair on each panel being designed for longitudinal interlocking engagement with an opposing edging (2), (3) extending from the panel surface (1) toward said understructure (14), said system comprising:

means for interlocking adjacent ones of said edgings (2), (3) of adjacent panels together when the angle between the panel surfaces (1) is changed, and at least one fastening device (22), (23) attached to a first fastening edging (2), that is turned away from another edging (3) interlocked with another panel, at a point along the length of said one edging (2), said fastening device having a profile complementary with the cross-sectional form of said first edging (2), said at least one fastening device (22), (23) being considerably shorter than the length of said first edging (2) and being supported on said firt edging for adjustment in a transverse direction from the panel surface (1) for fixing each panel to the understructure (14), said fastening edgings (2), (3), being supported by at least one supporting bead positioned between said edgings (2), (3) at the inner surface (2*a*), (3*a*), of the panel, said bead (10) supporting opposite fastening edgings (2), (3) of the panel on opposite sides thereof, and preventing buckling of each panel surface (1) by supporting opposing surfaces of said panels.

2. A system according to claim 1, wherein at least two of the opposite fastening edging profiles of each panel have a first profile comprising a groove and a second profile comprising a tongue interlocking with said groove in an adjacent panel, said second profile including an edging back surface (7) supporting edging and primarily extending beyond an edge (18) of the panel surface (1), a first flexible tongue projection (28) extending from the edging back surface toward the panel surface (1) to the inner surface of a side (29) of said first groove in the fastening edging of the adjacent panel into which groove the second profile will be inserted, and the first edging profile of the panel including a groove extending from the edge (17) of the panel surface (1) toward the center of the panel and opening toward said edge (17), an inner surface (29) of said first profile groove facing toward the panel surface (1) for coacting with the flexible tongue projection (28) of the fastening edging of the adjacent panel, and a supporting side (6) of said groove facing away from the surface (1) for coacting with the back surface (7) of the fastening edging of the adjacent panel, and a separate fastening device having a second flexible tongue projection (27) and a supporting surface (25) inside the panel flexible which surrounds the outer surface of the groove profile at the side (29) of the groove facing toward the panel surface (1) and at the supporting surface (6) of the groove facing away from the surface (1), the points of contact between the fastening device and the fastening edgings being provided with surface formations for improving the contact therebetween.

3. A system according to claim 1, wherein at least one of the panels, the fastening edgings (2), (3) of the panels, and the fastening devices (22), (23) are made from abendable flat material such as sheet metal, plastic or some other suitable material.

4. A system according to claim 1 wherein the panels are mounted on a wall understructure (14) in such a way that the fastening edgings (2), (3) are vertical whereby said panel is supported vertically be one or more fastening devices (22), (23) and preferably by the panel below resting on a gable edging (4), (5) perforated (15) for ventilation and suitably inclining upward from the panel surface (1) toward the understructure (14).

5. A system according to claim 2, wherein at least one of the panels, the fastening edgings (2), (3) of the panel, and the fastening devices (22), (23) are made from a bendable flat material such as sheet metal, plastic or some other suitable material.

6. A method for facing structures, wherein an understructure (14) is faced with several facing panels, each panel having a substantially planar surface, in which method said panels are mounted one by one and fixed to the understructure (14) so that a space is achieved between the understructure (14) and the surface (1) of the panel, the planar surface of each panel proper being surrounded by edgings (2), (3), (4), (5) generally directed towards the understructure (14), and at least two opposite fastening edgings (2,3) of each panel proper being interlockable with the respective fastening edgings of two adjacent panels by turning one panel in relation to an adjacent one, wherein the method further comprises the following steps:

fixing a separate fastening device (22), (23), comprising a fixing part (24) to be fastened to the understructure, to that inner side of the fastening edging (2) which is turned towards the center of each panel proper;

turning said panel into a position where it is inclined with respect to the understructure (14);

slipping the edgings (3) opposite to the edging (2) having the fastening device fixed thereto into the fastening edging of an adjacent panel which is already fixed to the understructure (14);

pushing said other edging (2) having the fastening device (22), (23) fixed thereto toward the understructure (14); and fixing said fixing part (24) of said fastening device (22), (23) to the understructure (14).

7. The method of claim 6, wherein each fastening device further includes a flexible tongue (27) and a channel portion, having opposing arms and an interconnecting base, for engagement about one of the panel edgings, said fixing part and said flexible tongue being disposed on opposite sides of said channel portion, and wherein said step of fixing comprises:

inserting said flexible tongue of said fastening device into a slit (30), defined between a surface of the fastening edging adjacent the panel planar surface and the planar surface itself, such that said channel base faces toward the center of the panel to which it is to be attached, and righting said fastening device by turning said channel portion base away from said panel center so that said channel portion becomes engaged about said fastening edging and so that said fixed part extends away from said panel center, and said step of pushing comprises:

turning said panel to be attached, relative to said panel already fixed to the understructure, about a longitudinal axis defined by the edging of the fixed panel into which the edging of the panel to be attached has already been inserted, so that when the turning has been completed, the panel to be attached is locked substantially planar with the fixed panel.

8. A method according to claim 6, wherein said panel edgings further include opposing gable edging perforated for ventilation, and said step of turning comprises first aligning said panel on the wall understructure (14) in such a way that the fastening edgings (2), (3) are vertical and said gable edgings are horizontal whereby said panel can be supported vertically on said understructure by one or more fastening devices (22), (23 and then positioning the lower gable edging of said panel to be attached over the upper gable edging of an already fixed panel disposed below.

* * * * *